US006034047A

United States Patent [19]

Au et al.

[11] Patent Number: 6,034,047

[45] Date of Patent: Mar. 7, 2000

[54] BLEACH DETERGENT COMPOSITIONS COMPRISING NITRONES AND NITROSO SPIN TRAPS

[76] Inventors:

Van Au, 18 Forbes Rd.; Stephen Alan Madison, 24 Oriole Rd., both of New City, N.Y. 10956; Peter Di Giacomo, Lingtor, 25 Old Fieldway, Heswall Wirral, United Kingdom, L60 6RQ

[21] Appl. No.: 09/148,750

[22] Filed: Sep. 4, 1998

[51] Int. Cl.[7] ..... C11D 3/395; C11D 7/18; C11D 7/54; C11D 9/00; C11D 9/42

[52] U.S. Cl. ..... 510/372; 510/376; 510/309; 510/312; 510/503

[58] Field of Search ..... 510/372, 375, 510/376, 309, 312, 503

[56] References Cited

U.S. PATENT DOCUMENTS

| | | | |
|---|---|---|---|
| 4,412,934 | 11/1983 | Chung et al. . | |
| 5,041,232 | 8/1991 | Batal et al. | 252/94 |
| 5,047,163 | 9/1991 | Batal et al. . | |
| 5,686,233 | 11/1997 | Valet et al. | 430/512 |
| 5,723,502 | 3/1998 | Proctor . | |

FOREIGN PATENT DOCUMENTS

| | | |
|---|---|---|
| 1095756 | 11/1994 | China . |

*Primary Examiner*—Yogendra Gupta
*Assistant Examiner*—John M Petruncio

[57] ABSTRACT

A bleaching composition comprising a peroxygen bleaching compound and preferably a bleach activator. When nitrone scavengers are used in such composition, dye and/or fabric damage caused by radical generations of the peroxygen bleach (e.g., through thermal or transmit ion metal catalyzed degradation) can be minimized.

4 Claims, No Drawings

BLEACH DETERGENT COMPOSITIONS COMPRISING NITRONES AND NITROSO SPIN TRAPS

FIELD OF THE INVENTION

The present invention relates to laundry detergent compositions containing bleach (and preferably bleach activators as well) to enhance removal of stains and soil.

BACKGROUND OF THE INVENTION

Bleaching compositions, i.e., compositions containing a peroxygen bleaching compound as well as compositions containing bleach activators to help oxygen release at all temperatures, are well known in the art. U.S. Pat. No. 4,412,934 to Chung et al., for example, teaches bleaching compositions providing effective and efficient surface bleaching over a wide range of bleach solution temperatures. U.S. Pat. No. 5,047,163 to Batal et al. teaches a specific class of activators (also known as bleach precursors) used in bleaching compositions.

One major drawback with all compositions comprising peroxygen bleach compounds is that these compositions can cause damage to fabric such as dye damage and/or loss of textile strength of fabric fibers. The damage appears to be worse in the presence of transition metal ions such as copper, iron, manganese or chromium. Such metals are often naturally found in water or as minor contaminants in the ingredients which comprise the bleaching formulations. They may also come from food stains. Without wishing to be bound by theory, it is believed that the peroxygen bleach compounds themselves may be responsible for dye and fabric damage, and further that the metal ions noted above may catalyze the decomposition of peroxygen bleaches to form highly reactive radical species that are responsible for such damage.

In one embodiment of the invention, applicants have now found that a class of radical scavengers, known as nitrones, significantly reduce dye and fabric damage caused by peroxygen bleach compounds, particularly those found in compositions comprising the transition metals noted above. Again, without wishing to be bound by theory, it is believed that the nitrones react with radical species to form secondary radicals that are less reactive by nature. Less reactive radicals will in turn result in less dye and fabric damage.

In a second embodiment of the invention, another class of scavengers, known as nitroso spin traps, also reduce dye and fabric damage caused by peroxygen bleach compounds, especially those containing transition metals as noted above.

Chinese Patent No. 1,095,756 describes the use of "nitrones" in liquid detergent for removal of thick grease and collected carbon on mechanical parts; and for use on ceramics, plastics and other ware. There is no teaching of nitrones in a bleach containing liquid formulation, let alone any teaching or suggestions that nitrones could react with radicals produced from peroxygen bleach compounds to prevent dye or fabric damage.

U.S. Pat. No. 5,723,502 to Peter Proctor describe nitrone and nitrone spin traps and a method for treating hair loss. There is no teaching or suggestion of use of these compounds in bleach liquid formulations.

BRIEF SUMMARY OF THE INVENTION

In one embodiment the present invention comprises a fabric detergent composition comprising:

(1) 0 to 80% by wt., preferably 1–75%, more preferably 5% to 65% by wt. of a surfactant selected from the group comprising of anionic surfactant, nonionic surfactant, amphoteric surfactant, zwitterionic surfactant, cationic surfactant and mixtures thereof;

(2) 0.1 to 95%, preferably 0.1 to 70% by wt., more preferably 1 to 60%, more preferably 1 to 20% by wt. of a peroxygen bleaching compound;

(3) 0 to 60%, preferably 0.1 to 50% by wt., more preferably 0.5 to 40% by wt. and most preferably 0.5 to 20% by wt. of a bleaching activator compound; and (4) 0.1 to 50% by wt., preferably 1% to 25% by wt. of nitrone having the general formula as follows:

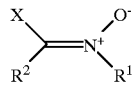

wherein $R^1$, $R^2$ and X are hydrogen, alkyl, alkylene, aryl, alkylaryl, heteroaryl (e.g., alcohols, esters, amines, halogens, etc.), water solubilizing group such as $SO_3H$, $^+N(R^3)_4$, COH, where $R^3$ is hydrogen, alkyl, alkylene, aryl, alkylaryl, heteroaryl; and $R^1$, $R^2$ and X my also form part of an aromatic ring system such as in the cyclic nitrones, described in "Multiple Mechanisms for Inhibition of Low Density Lipoprotein Oxidation by Novel Cyclic Nitrone Spin Traps" by Thomas et al., Journal of Biological Chemistry 200 (45):28055 (1994), hereby incorporated by reference in the subject application.

In a second embodiment, the invention is the same as described for the first embodiment except that component (4) comprises 0.1 to 50% by wt. of a nitroso spin trap having the general formula:

wherein R is as defined for $R^1$, $R^2$ and X of the nitrone compound. The nitroso spin traps generally are as defined in U.S. Pat. No. 5,732,502 to Proctor, hereby incorporated by reference into the subject application.

According to the invention, when radical species generated by the decomposition of peroxygen compound are formed (e.g., through thermal decomposition and/or decomposition generated by transition metals), these radicals react with (1) nitrones and/or (2) nitroso spin traps to form an unreactive radical species and accordingly dye in fabric change is averted.

DETAILED DESCRIPTION OF THE INVENTION

The present invention relates to fabric detergent compositions comprising peroxygen bleach compound and specific classes of radical scavengers (e.g., nitrones or nitroso spin traps) which scavenge harmful radical species produced by the thermal or metal catalyzed decomposition of the peroxygen bleach. Unexpectedly, applicants have found that these nitrone compounds or nitroso spin traps can be used in detergent bleach compositions to deter the harmful effect of these radicals, particularly in compositions comprising radical generating transition metals. The compositions of the invention are described in greater detail below.

Peroxygen Bleaching Compound

The peroxygen bleaching compounds useful herein are those capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono- and tetra-hydrate, sodium carbonate peroxyhydrate, sodium pyrophosphate peroxyhydrate, urea peroxyhydrate, and sodium peroxide. Particularly preferred are sodium perborate tetrahydrate and, especially, sodium perborate monohydrate. Sodium perborate monohydrate is especially preferred because it is very stable during storage and yet still dissolves very quickly in the bleaching solution. It is believed that such rapid dissolution results in the formation of higher levels of percarboxylic acid and, thus, enhanced surface bleaching performance.

The level of peroxygen bleach within compositions of the invention is from about 0.1% to about 95% and preferably from about 1% to about 60%. When the bleaching compositions within the invention are also detergent compositions it is preferred that the level of peroxygen bleach is from about 1% to about 20%.

Bleach Activator

In addition to the required peroxygen bleaching compound, the compositions of the invention will preferably contain a bleach activating compound (bleach precursor). Such bleach precursor will have the general formula:

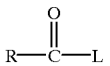

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pk_a$ in the range of from about 6 to about 13.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attack by the perhydroxide anion. Leaving groups that exhibit such behavior are those in which their conjugate acid has a $pk_a$ in the range of from about 6 to about 13, preferably from about 7 to about 11 and most preferably from about 8 to about 11.

The bleach precursor may be any of the precursor recited in U.S. Pat. No. 4,412,934 to Chung et al. incorporated hereby by reference into the subject application as well as any of the sulfonomine precursors disclosed in U.S. Pat. No, 5,047,463 or U.S. Pat. No. 5,041,232 to Batal et al., both of which are hereby incorporated by reference into the subject application.

The precursor may comprise 0 to 60% by wt., preferably 0.1 to 50% by wt., more preferably 0.5 to 40% by wt. of the composition. When used in detergent compositions, it is preferred that the level be 0.5 to 20% by wt. of the composition.

Nitrone

Typically, peroxygen bleach radicals may be produced as noted below (the example is for illustration purposes only):

Radical Generation

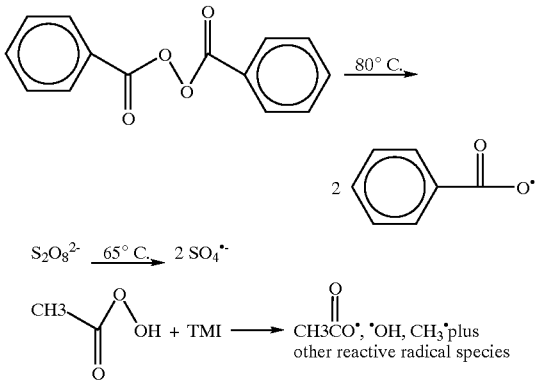

The radicals are generated as shown above either by thermal decomposition of benzyolperoxide, peroxydisulfate or transition metal ions (TMI) catalyzed decomposition of peroxyacetic acid.

Once a radical R is formed, it will react with a nitrone scavenger having the formula as follows:

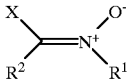

wherein $R^1$, $R^2$ and X are hydrogen, alkyl, alkylene, aryl, alkylaryl, heteroaryl (e.g., alcohols, esters, amines, halogens, etc.), water solubilizing group such as $SO_3H$, $N^+(R^3)_4$, COH, where $R^3$ is hydrogen, alkyl alkylene, aryl, alkylaryl or heteroaryl.

A typical reaction would be as follows:

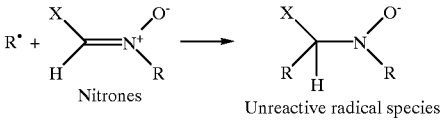

Nitroso Spin Traps

The radical may also react with a nitroso spin trap.

Optionals

In addition to required peroxygen compound and nitrones and/or nitroso spin traps (as well as preferred bleach activator), the compositions of the invention may contain other optional ingredients as noted below.

As a preferred embodiment, the bleaching compositions of the invention can be detergent compositions. Thus, the bleaching compositions can contain typical detergent composition components such as detergency surfactants and detergency builders. In such preferred embodiments the bleaching compositions are particularly effective. The bleaching compositions of this invention can contain all of the usual components of detergent compositions including the ingredients set forth in U.S. Pat. No. 3,936,537, Baskerville et al., incorporated herein by reference. Such components include color speckles, suds boosters, suds suppressors, anti-tarnish and/or anti-corrosion agents, soil-suspending agents, soil-release agents, dyes, fillers, optical brightness, germicides, alkalinity sources, hydrotropes, antioxidants, enzymes, enzyme stabilizing agents, perfumes, etc.

The detergent surfactants can be any one or more surface active agents selected from anionic, nonionic, zwitterionic, amphoteric and cationic classes and compatible mixtures thereof. Detergent surfactants useful herein are listed in U.S. Pat. No. 3,664,961, Norris, issued May 23, 1972, and in U.S. Pat. No. 3,919,678, Laughlin et al., issued Dec. 30, 1975, both incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference. The following are representative examples of detergent surfactants useful in the present compositions.

Water soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water soluble salts, preferably the alkali metal, ammonium and alkylammonium salts, of organic sulfuric reaction products having in their molecular structure an alkyl group containing from about 10 to about 20 carbon atoms and a sulfonic acid or sulfuric acid ester group (included in the term "alkyl" is the alkyl portion of acyl groups). Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water soluble salts of 2-acyloxyalkane-1-sulfonic acids containing from about 2 to 9 carbon atoms in the acyl group and from about 9 to about 23 carbon atoms in the alkane moiety; water soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water soluble and water dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms wit from about 4 to 8 moles of ethylene oxide per mole of alcohol.

Semi-polar nonionic surfactants include water soluble amine oxides containing one alkyl moiety of from about 10 to 18 carbon atoms and two moieties selected from the group of alkyl and hydroxyalkyl moieties of from about 1 to about 3 carbon atoms; water soluble phosphine oxides containing one alkyl moiety of about 10 to 18 carbon atoms and two moieties selected from the group consisting of alkyl groups and hydroxyalkyl groups containing from about 1 to 3 carbon atoms; and water soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water solubilizing group.

Zwitterionic surfactants include derivatives of aliphatic, quaternary, ammonium, phosphonium, and sulfonium compounds in which one of the aliphatic substituents contains from about 8 to 18 carbon atoms.

The level of detergent surfactant that can be employed is from 0% to about 80%, preferably from about 1% to about 70% and most preferably from about 5% to about 65% by weight of the total composition.

In addition to detergent surfactants, detergency builders can be employed in the bleaching compositions. Water soluble inorganic or organic electrolytes are suitable builders. The builder can also be water insoluble calcium ion exchange materials; non-limiting examples of suitable water soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water soluble amino carboxylates and aminopolyacetates, for example, nitrilotriacetates, glycinates, ethylenediamine, tetraacetates, N-(2-hydroxyethyl)nitrilo diacetates and diethylenetriamine pentaacetates; (2) water soluble salts of phytic acid, for example, sodium and potassium phytates; (3) water soluble, polyphosphonates, including sodium, potassium and lithium salts of ethane-1-hydroxy-1, diphosphonic acid; sodium, potassium and lithium salts of ethylene diphosphonic acid; and the like; (4) water soluble polycarboxylates such as the salts of lactic acid, succinic acid, malonic acid, maleic acid, citric acid, carboxymethyloxysuccinic acid, 2-oxa-1,1,3-propane tricarboxylic acid, 1,1,2,2-ethane tetracarboxylic acid, mellitic acid and pyromellitic acid; and (5) water soluble polyacetals as disclosed in U.S. Pat. Nos. 4,144,266 and 4,246,495 incorporated herein by reference.

Another type of detergency builder material useful in the present compositions comprises a water soluble material capable of forming a water insoluble reaction product with water hardness cations preferably in combination with a crystallization seed which is capable of providing growth sites for said reaction product. Such "seeded builder" compositions are fully disclosed in British Patent No. 1,424,406.

A further class of detergency builder materials useful in the present invention are insoluble sodium aluminosilicates, particularly those described in Belgian Patent No. 814,874, issued Nov. 12, 1974, incorporated herein by reference. This patent discloses and claims detergent compositions containing sodium aluminosilicates having the formula:

$$Na_z(AlO_2)_z(SiO_2)_yXH_2O$$

wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligranms equivalent/gram and a calcium ion exchange rate of at least about 2 grains/-gallon/minute/gram. A preferred material is Zeolite A which is $$Na_{12}(SiO_2AlO_2)_{12}27H_2O$$

The level of detergency builder of the bleaching compositions is from 0% to about 70%, preferably from about 10% to about 60% and most preferably from about 20% to about 60%.

Buffering agents can be utilized to maintain the desired alkaline pH of the bleaching solutions. Buffering agents include, but are not limited to many of the detergency builder compounds disclosed hereinbefore. Buffering agents suitable for use herein are those well known in the detergency art.

Preferred optional ingredients include suds modifiers particularly those of suds suppressing types, exemplified by silicones, and silica-silicone mixtures.

U.S. Pat. Nos. 3,933,672, issued Jan. 20, 1976 to Bartolotta et al., and U.S. Pat. No. 4,136,045, issued Jan. 23, 1979 to Gault et al., incorporated herein by reference, discloses silicone suds controlling agents. The silicone material can be represented by alkylated polysiloxane materials such as silica aerogels and xerogels and hydrophobic silicas of various types. The silicone material can be described as siloxane having the formula:

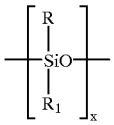

wherein x is from about 20 to about 2,000 and R and $R^1$ are each alkyl or aryl groups, especially methyl, ethyl, propyl, butyl and phenyl. The polydimethylsiloxanes (R and $R^1$ are methyl) having a molecular weight within the range of from about 200 to about 2,000,000, and higher, are all used as suds controlling agents. Additional suitable silicone materials wherein the side chain groups R and $R^1$ are alkyl, aryl, or mixed alkyl or aryl hydroxycarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm, intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water soluble or water dispersible, substantially non-surface-active detergent impermeable carrier.

Particularly useful suds suppressers are the self-emulsifying silicone suds suppressors, described in U.S. Pat. No. 4,073,118, Gault et al., issued Feb. 21, 1978, incorporated herein by reference. An example of such a compound is DB-544, commercially available from Dow Corning, which is a siloxane/glycol copolymer.

Suds modifiers as described above are used at levels of up to approximately 2%, preferably from about 0.1 to about 1-½ by weight of the surfactant.

Microcrystalline waxes having a melting point in the range from 35° C.–115° C. and a saponification value of less than 100 represent additional examples of preferred suds control components for use in the subject compositions, and are described in detail in U.S. Pat. No. 4,056,481, Tate, issued Nov. 1, 1977, incorporated herein by reference. The microcrystalline waxes are substantially water insoluble, but are water dispersible in the presence of organic surfactants. Preferred micro crystalline waxes have a melting point from about 65° C. to 100° C., a molecular weight in the range from 400–1,000; and a penetration value of at least 6, measured at 77° F. by ASTD-D1321. Suitable examples of the above waxes include: microcrystalline and oxidized microcrystalline petroleum waxes; Fischer-Tropsch and oxidized Fischer-Tropsch waxes; ozokerite, ceresin; montan wax; beeswax; candelilla; and carnauba wax.

Alkyl phosphate esters represent an additional preferred suds control agent for use herein. These preferred phosphate esters are predominantly monostearyl phosphate which, in addition thereto, can contain di- and tristearyl phosphates and monooleyl phosphate, which can contain di- and trioleyl phosphate.

Other suds control agents useful in the practice of the invention are the soap or the soap and nonionic mixtures as disclosed in U.S. Pat. Nos. 2,954,347 and 2,954,348, incorporated herein by reference.

The following examples are given to illustrate the parameters of and compositions within the invention. All percentages, parts and ratios are by weight unless otherwise indicated.

Sufficient water should be added to make 100% by wt. composition.

EXAMPLES

In general, the protective effects of nitrones against dye damage were evaluated by washing a commercially available dye cloth monitors in the presence or absence of a nitrone radical scavenger. The change in delta E of the dye monitor correlated to the magnitude of dye damage. Higher delta E value mans higher magnitude of dye damage.

The following nitrones were used during evaluation experiments:

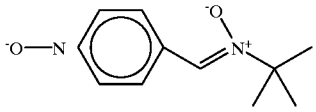

POBN
[POBN = N-tert-Butyl-α-(4-pyridyl)-nitrone N'-oxide]

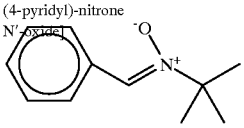

PBN
[PBN = N-tert-butyl-α-phenyl-nitrone

Example 1

Experiments were conducted in 200 ml of deionized water, each container having a stir bar and employing two 2"×2" test monitor (four different test monitors were used) at 80° C. with 5 mM of benzoyl peroxide (added to induce change). The test cloths were stirred (agitated) for 30 minutes. The control runs contained no radical scavenger while the other contained 10 mM of POBN as radical scavenger. The results are summarized in Table 1. As seen, test monitors washed in solution containing POBN as radical scavenger showed significantly reduced dye damage (ΔE is lower) compared to the control (without radical scavenger).

TABLE 1

| Test Monitor (cloth)* | Delta E (control) | Delta E (POBN) |
|---|---|---|
| P10CD | 392 | 26.6 |
| P07CR | 13.2 | 6 |
| P04CR | 23.4 | 14.3 |
| P05CR | 46.9 | 41.2 |

*Commercially available material, for example, from Test Fabric Company

Experiments were conducted in 200 ml of deionized water each containing 50 mM of sodium carbonate as buffer with a stir bar, employing two 2"×2" test monitors (3 different monitors used and each repeated three times) at 60° C. with 5 mM of peroxydisulfate. The test cloths were stirred (agitated) for 60 minutes. The control runs contained no radical scavenger while the other contained 10 mM of POBN as radical scavenger. Multiple washes were conducted in these experiments to simulate normal washing processes. The results are summarized in Table 2. As seen, test monitors washed in a solution containing POBN as radical scavenger showed significantly reduced dye damages compared to the control run (without radical scavenger).

TABLE 2

| Test Monitor | Wash # | Delta E (control) | Delta E (POBN) |
|---|---|---|---|
| P05CR | 1 | 4.1 | 3.1 |
| | 2 | 8.1 | 6 |
| | 3 | 10.7 | 7.3 |
| P10CD | 1 | 2 | 1.7 |
| | 2 | 3.1 | 3 |
| | 3 | 6.7 | 5.1 |
| P04CR | 1 | 1.8 | 1.1 |
| | 2 | 2.5 | 1.8 |
| | 3 | 2.6 | 1.7 |

Example 3

The experiments were conducted in 200 ml of deionized water each containing 0.2 g of commercial detergent Surf® formulation, TMI (1.1 ppm Cu, 2 ppm Fe,2.3, ppm Zn and 0.12 ppm Mn), and a stir bar, employing two 2"×2' test monitors (one monitor, P05CR multiple washes) at 60° C. with 4 mM peroxyacetic acid as peroxygen bleach. The test cloths were stirred (agitated) for 30 minutes. The control runs contained no radical scavenger while the other contained either 10 mM of POBN or 10 mM of PBN as radical scavenger. Multiple washes were conducted in these experiments to simulate normal washing processes. The results are summarized in Table 3. As seen, test monitor washes in solution containing POBN or PBN as radical scavenger showed significantly reduced dye damages compared to the control run (without radical scavenger).

TABLE 3

| Test Monitor | Wash # | Delt E (control) | |
|---|---|---|---|
| | | | Delta E (PBN) |
| P05CR | 1 | 1.2 | 0.9 |
| | 2 | 3.2 | 1.6 |
| | 3 | 4.6 | 2.3 |
| | 4 | 5.2 | 3.3 |
| | | | Delta E (POBN) |
| P05CR | 1 | 1.3 | 0.9 |
| | 2 | 2.1 | 1.1 |
| | 3 | 3.3 | 2.3 |

We claim:

1. A bleaching composition comprising:

(a) 0 to 80% by wt. of a surfactant selected from the group consisting of anionic, nonionic, amphoteric, zwitterionic, cationic surfactants and mixtures thereof;

(b) 0.1 to 95% by wt. of a peroxygen bleaching compound;

(c) 0 to 60% by wt. of a bleach activator;

(d) 0.1% to 50% by wt. of a nitrone; and (e) balance water.

2. A composition according to claim 1, wherein nitrone is POBN.

3. A composition according to claim 1, wherein nitrone is PBN.

4. A bleaching composition comprising:

(a) 0 to 80% by wt. of a surfactant selected from the group consisting of anionic, nonionic, amphoteric, zwitterionic, cationic surfactants and mixtures thereof;

(b) 0.1 to 95% by wt. of a peroxygen bleaching compound;

(c) 0 to 60% by wt. of a bleach activator;

(d) 0.1% to 50% by wt. of a nitroso spin traps; and (e) balance water.

* * * * *